US005184180A

United States Patent [19]

Choi

[11] Patent Number: 5,184,180

[45] Date of Patent: Feb. 2, 1993

[54] METHOD FOR SUPPLYING POWER TO A COPYING MACHINE

[75] Inventor: Hoon B. Choi, Seoul, Rep. of Korea

[73] Assignee: Gold Star Co., Ltd., Seoul, Rep. of Korea

[21] Appl. No.: 712,892

[22] Filed: Jun. 12, 1991

[30] Foreign Application Priority Data

Jun. 18, 1990 [KR] Rep. of Korea ..... 8907/1990

[51] Int. Cl.[5] ..... G03G 15/02

[52] U.S. Cl. ..... 355/219; 355/222; 355/271

[58] Field of Search ..... 355/271, 273, 274, 219, 355/222, 246

[56] References Cited

U.S. PATENT DOCUMENTS 4,338,017 7/1982 Nishikawa .

4,341,457 7/1982 Nakahata et al. .

4,994,861 2/1991 Brandon et al. ..... 355/274

*Primary Examiner*—Richard L. Moses

*Attorney, Agent, or Firm*—Finnegan, Henderson, Farabow, Garrett and Dunner

[57] ABSTRACT

In the copying machine including an electrifier, a developer, a developer roller, a transcriber, a discharging brush, a cleaning blade, a cleaning portion and a front and a rear guides, the guide and the discharging brush are grounds, the predetermined symmetric AC voltage is directly applied to the drum to generate the asymmetric AC power in the surface of a photosensitive drum.

13 Claims, 4 Drawing Sheets

METHOD FOR SUPPLYING POWER TO A COPYING MACHINE

BACKGROUND OF THE INVENTION

The present invention relates to a method for supplying power to a copying machine, and more particularly for applying a symmetric AC voltage to a photosensitive drum to generate an asymmetric AC potential on the surface of the drum so that a picture image of good quality can be obtained and stability of the surroundings can be improved.

Furthermore, in the present invention, the symmetric AC power and DC power instead of the conventional asymmetric AC power, where the configuration of circuit is complicated, are used for high voltage circuit so that the configuration of power circuit can be further simplified.

As shown in FIG. 1, the prior conventional copying machine comprises a photosensitive drum (1) which consists of a photosensitive body (1*a*) formed on the surface thereof and a supporting member (1*b*) for supporting the photosensitive body (1*a*), the an electrifier (2) for generating a uniform surface potential on the surface of the photosensitive drum (1) and electrifier power supply portion (3) for supplying a predetermined power to the electrifier (2), the enveloper (not shown) for enveloping the predetermined portion of the surface of the photosensitive drum (1) corresponding to the picture image to change the surface potential, a developer (4) consisting of a toner to be attached to the enveloped (or illuminated) portion or the unenveloped (or non-illuminated) portion of the surface of the photosensitive drum (1), a developer roller (5) for attaching toner to the enveloped portion or the unenveloped portion, the developer power supply portion (6) for supplying the predetermined power to the developer and the developer roller (5), a transcriber (7) for transferring and attaching toner attached to the predetermined portion of the surface of the photosensitive drum (1) to the paper, a transcriber power supply portion (8) for supplying the predetermined power to the transcriber (7), a discharging brush (9), to which the predetermined power is applied for discharging the charge generated on the surface of the transcribed paper through the transcriber (7), a discharging brush power supply portion (15) for supplying a predetermined power to the discharging brush (9), the cleaning blade (10) for scratching toner which is not transcribed to the paper but is remained on the surface of the photosensitive drum (1), a cleaning portion (11) for storing toner scratched by the cleaning blade (10), a front guide (12) for guiding the transcribing paper between the photosensitive drum (1) and the transcriber (7), a rear guide (13) for guiding the paper in which the toner is transcribed to be outputted and a guide power supply portion (14) for supplying a predetermined power to the front guide (12).

The above constituent elements will be described in detail as follows.

First, the photosensitive drum (1) consists of the photosensitive body (1*a*) formed on the surface thereof and the conductive supporting member (1*b*) for supporting said photosensitive body (1*a*) and said conductive supporting member (1*b*) is electrically grounded (0 V).

Furthermore, in general corona electrifier has been used for the electrifier (2) but in the copying machine as shown in FIG. 1, a roller electrifying method is used, which is now mostly used. The asymmetric AC power is used for the electrifier power supply portion (3) to increase the electrifying capability. The developer (4) consists of the developer roller (5) for smearing toner stored within with uniform depth and transferring it to the photosensitive drum (1) and the peripheral apparatus. The asymmetric AC power is used for the developer power supply portion (6) also to increase visibility of the developing picture image.

On the other hand, in general, corona transcriber has been used for the transcriber (7) but in the copying machine as shown in FIG. 1, a roller transcribing method is used, which is now mostly used. The symmetric AC power of a predetermined level is used for the transcriber power supply portion (8). The front guide (12) and the rear guide (13) are established in the peripheral of the transcriber (7). The symmetric AC power is used for the guide power supply portion (14) as well. In addition, the cleaning portion (11) and the cleaning blade (10) are equipped.

The operation of the conventional copying machine will be described as follows.

First, if the photosensitive drum (1) is rotated, the charge is accumulated on the surface of the photosensitive drum (1) by the electrifier (2) and the uniform surface potential is generated. If the photosensitive drum (1) reaches an enveloping position and light is radiated, the charge accumulated on the surface of the photosensitive drum (1) is discharged to the conductive supporting member (1*b*) in accordance with the quantity of the radiated light and the surface potential of the photosensitive drum (1) is changed.

Accordingly, the photosensitive drum (1) of which the surface charge is different in accordance with each portion, reaches the developer (4) by light radiated through the enveloper where toner is attached with a predetermined depth by the developer roller (5) and an electric field is applied from the developer power supply portion (6). Toner of fixed quantity is attached on the surface of the photosensitive drum (1) in accordance with the surface potential of the photosensitive drum (1).

Henceforth, if the photosensitive drum (1), where toner is attached, is adhered closely to the paper transferred by the front guide (12) and then reach the transcriber (7), toner attached on the surface of the photosensitive drum (1) is transferred to the paper by the magnetic field applied by the transcriber power supply portion (8). On the other hand, toner which is not transcribed is scratched from the photosensitive drum (1) by the cleaning blade (10) and it is stored in the cleaning portion (11) as disused toner.

FIG. 2 shows changes of the surface potential generated in each position of the peripheral of the photosensitive drum (1) and movement of toner as a graph.

As mentioned above, a method for supplying power to a copying machine of the prior art could be improved in the performance of a electrifier and a developer by applying the asymmetric AC power thereto. But, from a practical point of view, because configuration of circuit for generating the high asymmetric current is more complicated than that of a high DC voltage circuit or a symmetric AC power circuit, the unit cost of the product rises. Furthermore, because the asymmetric AC power, as shown in FIG. 3(A), is applied to the surface of the photosensitive drum (1) during enveloping and the symmetric AC power, as shown in FIG. 3(B), is applied during unenveloping, toner smeared on the surface of the photosensitive drum is not thinly attached over the whole surface and may be projected upward so that the quality of the picture image is degraded.

SUMMARY OF THE INVENTION

An object of the present invention is to provide a method for supplying power of copying machine to improve the quality to a the picture image, perform a stable operation of the copying machine regardless of the change in the peripheral power supply, and simply constitute each power supply portion circuit to reduce the unit cost of the product.

According to the preferred embodiment of the present invention, a method is provided for supplying power to a copying machine comprising a drum of which a photosensitive body is formed on the surface, an electrifier for generating uniform surface potential on the surface of the drum, an enveloper for enveloping a predetermined portion of the drum to change the potential and to form a latent image, a developer for attaching toner to the enveloped portion or the unenveloped portion of the surface of the drum, a transcriber for transferring and attaching toner attached to the surface of the drum to the paper, a front guide for guiding the paper between the drum and the transcriber, a rear guide for guiding the transcribed paper to be outputted and a discharging brush for discharging the charge generated in the paper, the brush and the front guide are grounded and the predetermined AC power is applied to the developer, the electrifier, and the transcriber, and the predetermined symmetric AC power is applied to the drum to generate the asymmetric AC power on the surface thereof.

BRIEF DESCRIPTION OF THE DRAWINGS

These and other objects of the invention will be better understood upon study of the Detailed Description of the Invention, provided below, together with the drawings, in which.

DETAILED DESCRIPTION OF THE PREFERRED EMBODIMENT

The preferred embodiment of the present invention will be described in more detail referring to FIG. 4 through FIG. 6.

Figure 1:
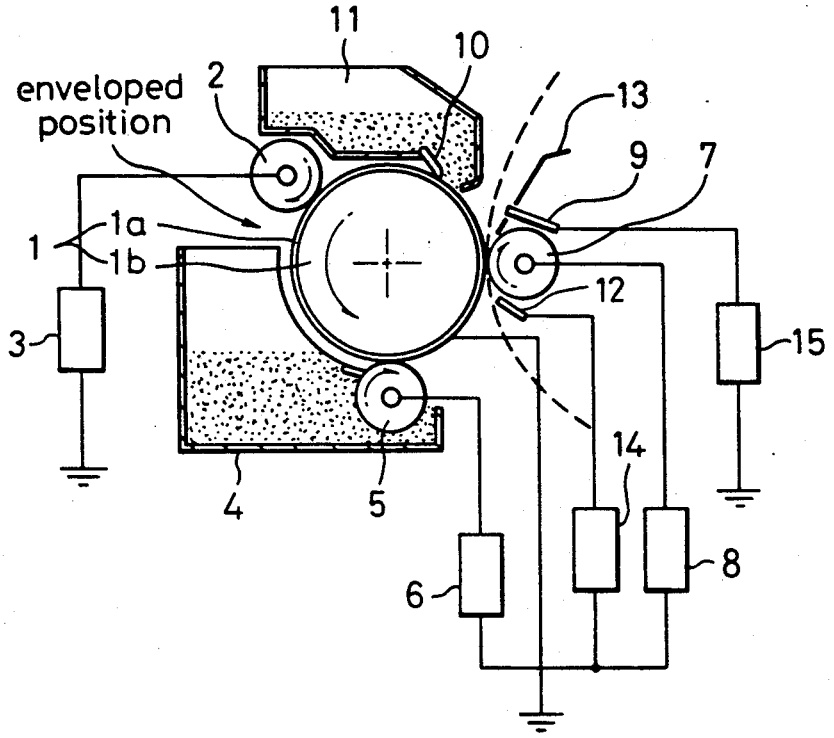
F I G. 1 PRIOR ART
FIG. 1 is a schematic configuration diagram of the peripheral of a photosensitive drum to explain a conventional method for supplying power to a copying machine.
Figure 2:
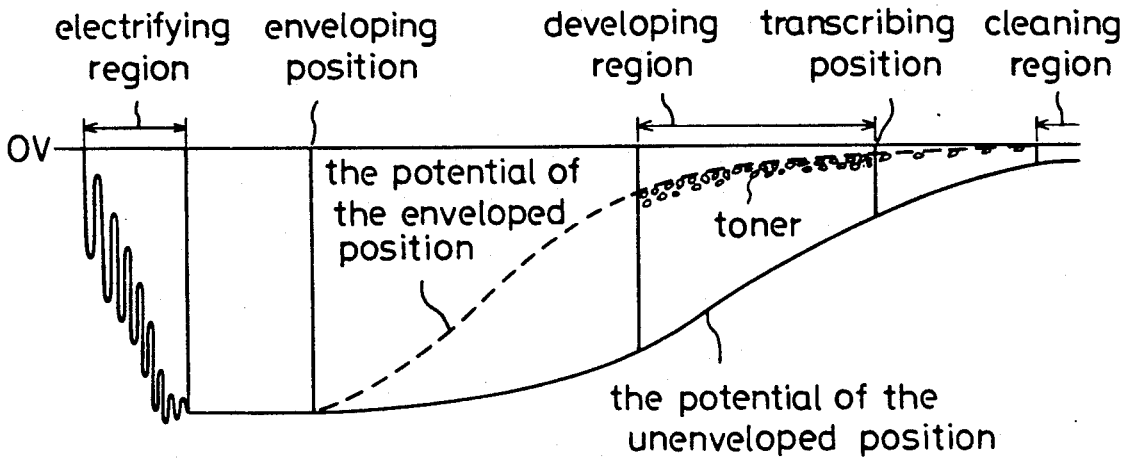
F I G. 2 PRIOR ART
FIG. 2 is a diagram showing changes of the surface potential of a photosensitive drum and movement of toner to explain a conventional method for supplying power to a copying machine.
Figure 3A:
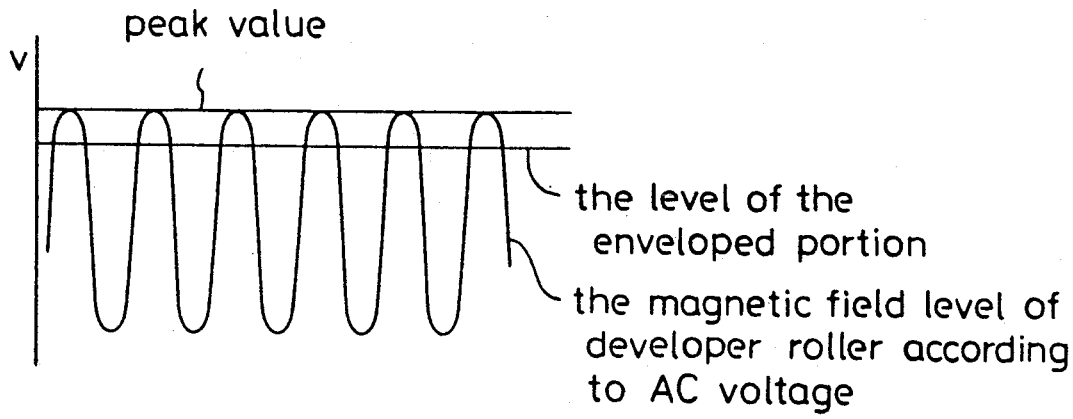
FIG. 3a PRIOR ART
FIG. 3(A) is a waveform of the asymmetric AC power for applying to the surface of a photosensitive drum during enveloping according to a conventional method for supplying power.
Figure 3B:
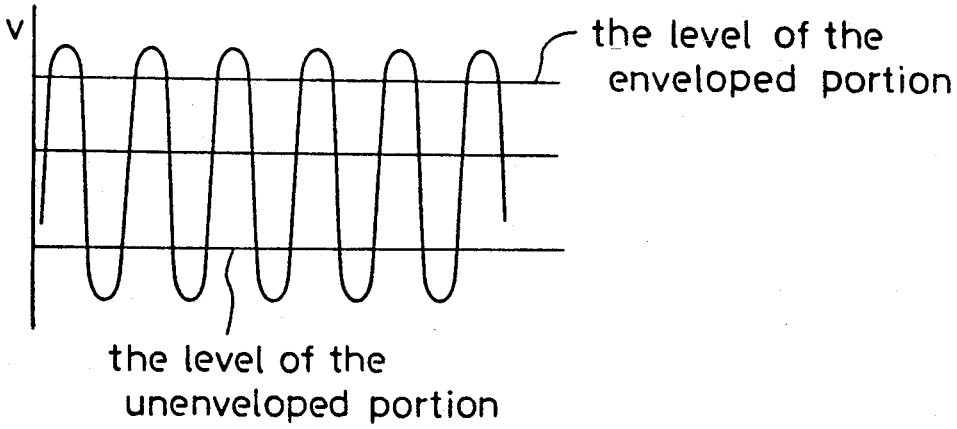
FIG. 3b PRIOR ART
FIG. 3(B) is a waveform of the symmetric AC power for applying to the surface of a photosensitive drum during unenveloping according to a conventional method for supplying power.
Figure 4:
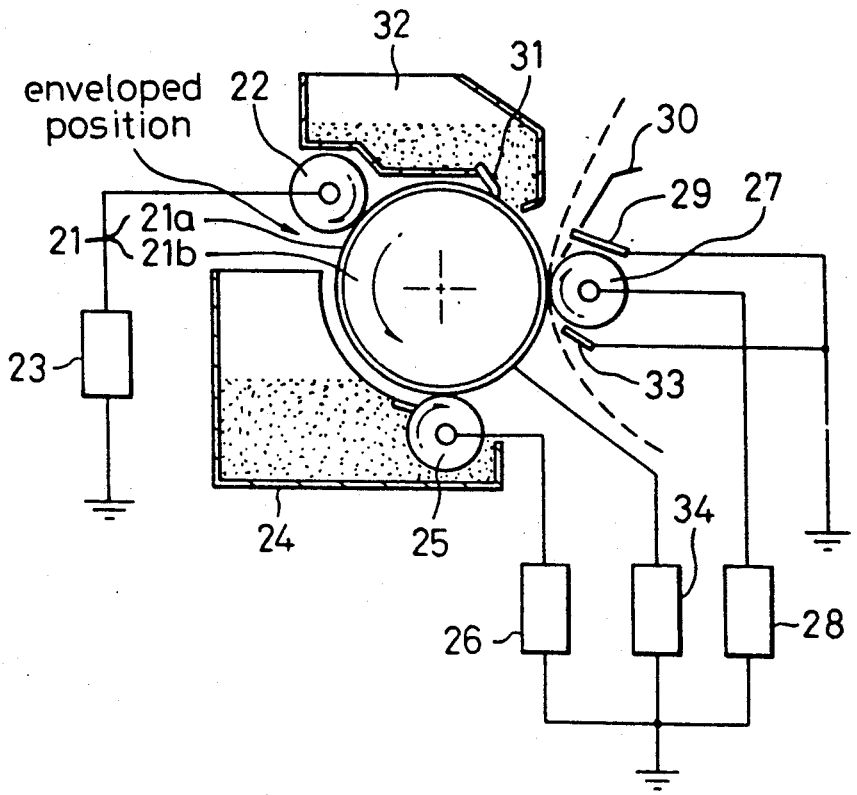
FIG. 4 is a schematic configuration diagram of the peripheral of a photosensitive drum to explain a method for supplying power of a copying machine of the present invention.

FIG. 4 shows a copying machine according to the present invention including a rotatable photosensitive drum(21) having a photosensitive body(21*a*) formed in the surface thereof and a supporting member(21*b*) for supporting the body(21*a*), and the electrifier(22) for generating the uniform surface potential on the surface of the photosensitive drum(21), an electrifier power supply portion(23) for supplying a predetermined DC power to the electrifier(22), an enveloper (not shown) for enveloping a predetermined portion of the surface of the photosensitive drum(21) corresponding to the picture image to change the surface potential thereof and to form the latent image, a developer(24) for storing toner to be attached to the surface of the photosensitive drum(21), a developer roller(25) for attaching toner stored in the developer(24) to the enveloped or unenveloped portion of the surface of the photosensitive drum(21) by the polarity of the toner, a developer power supply portion(26) for supplying the predetermined DC power or the predetermined DC power and the predetermined symmetric AC power to the roller(25), a transcriber(27) for transferring and attaching toner attached on the surface of said photosensitive drum(21) to the paper, a transcriber power supply portion(28) for supplying the predetermined DC power to the transcriber(27), a discharging brush(29) for discharging the charge generated on the surface of the paper to which the toner is transcribed, a rear guide(30) for guiding the paper to which toner is transcribed to be outputted, a cleaning blade(31) for scratching the toner of the surface of the photosensitive drum(21) which is not transcribed to the paper, a cleaning portion(32) for storing toner scratched to the paper, the cleaning portion(32) for storing toner scratched by the cleaning blade(31), a front guide(33) for guiding the transcribed paper between the photosensitive drum(21) and the transcriber(27), and a photosensitive drum power supply portion(34) for supplying the predetermined symmetric AC power to the photosensitive drum(21).

At this time, a roller is used for the electrifier(22) and the transcriber(27).

Figure 5A:
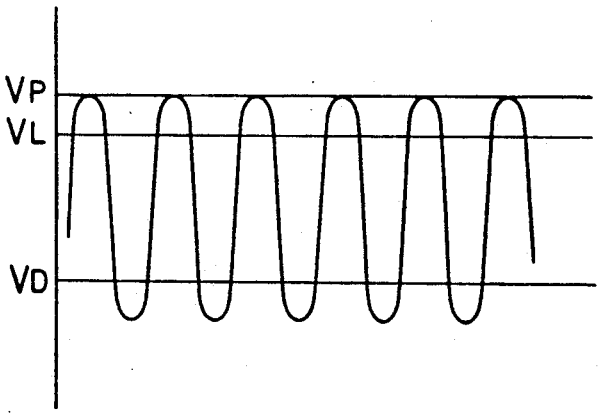
FIG. 5(A) is a waveform of the voltage for applying to a photosensitive drum during enveloping according to a method for supplying power of the present invention.

The operation and the effect of the present invention according to the aforesaid configuration will be described with reference to FIGS. 5(A) and (B) and FIGS. 6(A) and (B).

Figure 5B:
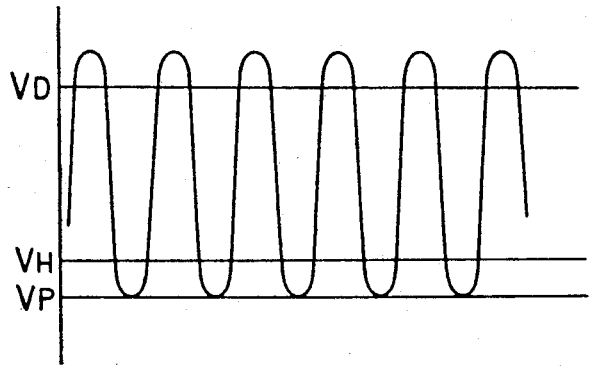
FIG. 5(B) is a waveform of the voltage for applying to a photosensitive drum during unenveloping according to a method for supplying power of the present invention.
Figure 6A:
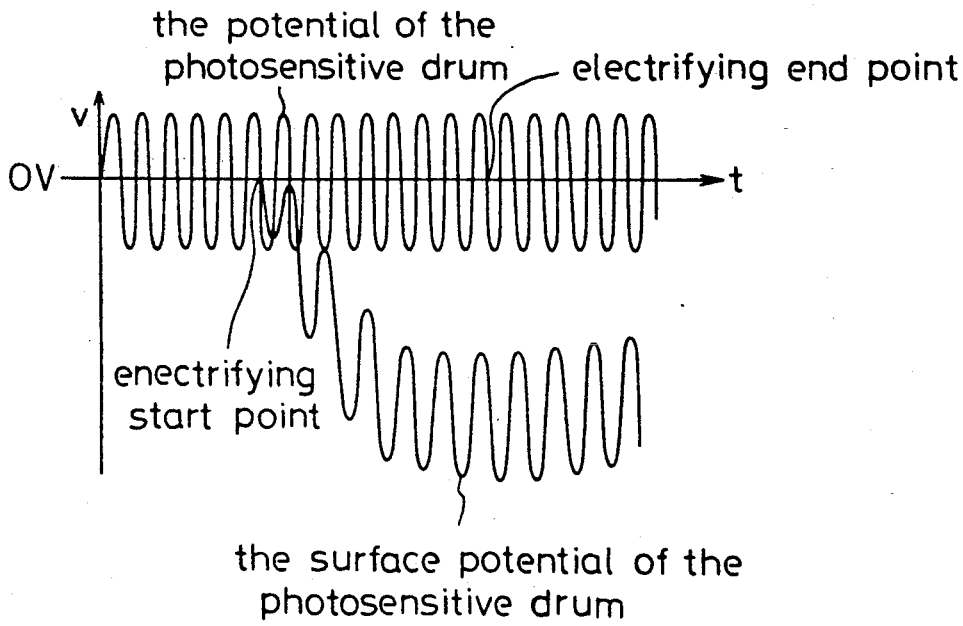
FIG. 6(A) is a diagram showing changes of the surface potential of a photosensitive drum in the peripheral of an electrifier according to a method for supplying power of the present invention.

Normally, during unenveloping, if the photosensitive drum(21) which the symmetric AC power, as shown in FIG. 5(B), is applied to is passed through the electrifier(22), the surface potential of the photosensitive drum(21) is swung with the DC component to the photosensitive drum power supply portion(34) as shown in FIG. 6(A).

Figure 6B:
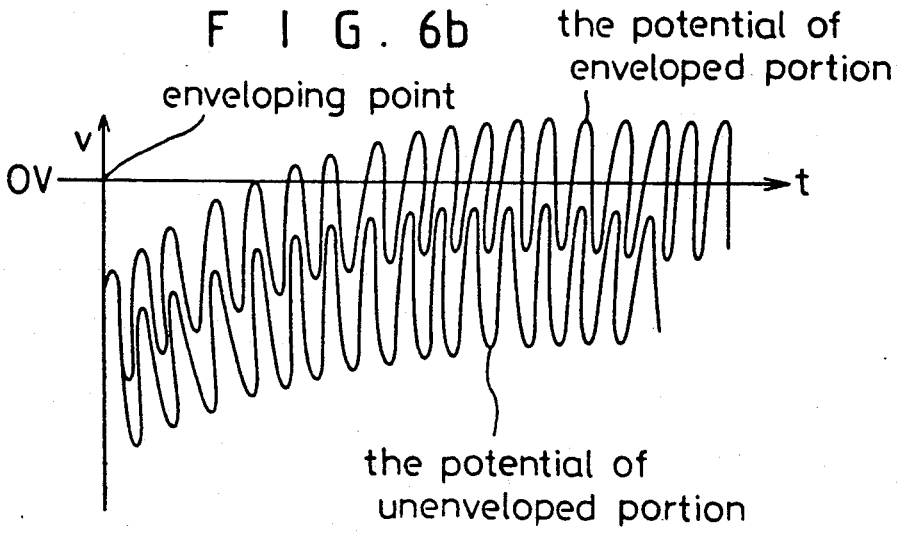
FIG. 6(B) is a diagram showing changes of the surface potential of a photosensitive drum in radiating light according to a method for supplying power of the present invention.

Henceforth, if the photosensitive drum(21) reaches the enveloping position and light is radiated on the portion corresponding to a video signal, a potential difference is uniformly generated between the portion on which light is radiated and the portion on which light is not radiated. Furthermore, as shown in FIG. 6(B), the potential difference generated by the light radiation is swung synchronously with the surface potential of the photosensitive drum(21). Therefore, the latent image is formed on the surface of the photosensitive drum(21) by the electric surface potential difference generated by light radiation.

Subsequently, if the latent image formed on the surface of the photosensitive drum(21) reaches the developer roller(25) as a developing area, toner reciprocates in a developing area, that is, between the developer roller(25) and the photosensitive drum(21) by means of symmetric AC power applied to the photosensitive drum(21), against the developer roller(25) to which a predetermined DC power is applied from the developer power supply portion(26). At this time, if the value of the DC voltage applied to the developer roller(25) is between the average potential($V_L$) of the enveloped portion of the surface of the photosensitive drum(21) and the average potential($V_H$) of the unenveloped portion as shown in FIGS. 5(A) and (B), then toner is attached to the enveloped portion or the unenveloped portion of the surface of the photosensitive drum(21) in accordance with the polarity thereof and the electrical latent image becomes a visible picture image.

That is, if the surface potential of the enveloped portion of the surface of the photosensitive drum(21) is represented by $V_L$, the surface potential of the unenveloped portion of the surface of the photosensitive drum(21) is represented by $V_H$, the potential of the developer roller(25) applied from the developer power supply portion(26) is represented by $V_D$, and the peak value applied to the photosensitive drum(21) is represented by $V_P$, then the potential applied to the developer roller(25) can be expressed by the following formula(1):

$$|V_L| < |V_D| < |V_H| \quad (1).$$

Accordingly, the relationship between the potential applied to the developer roller(25) and the potential applied to the photosensitive drum(21) can be expressed by the following formulas(2) and (3):

$$|V_L| + |V_P| > |V_D| \quad (2)$$

$$|V_H| + |V_P| < |V_D| \quad (3).$$

According to aforesaid formulas(1) through (3), reciprocation of toner prevents the toner from attaching to a non-image area and from concentrating by means of a characteristic thereof and the humidity in the developing process which improves the sharpness of the picture quality.

Furthermore, the picture image formed on the photosensitive drum(21) is transferred to the transcriber(27) by rotation of the photosensitive drum(21) and at this time, the picture image is laid upon the transferred paper in the front guide(33).

Henceforth, the charge is formed on the surface of the transferred paper by the friction between the paper and roller or between the papers in supplying the paper. At this time, toner attached to the photosensitive drum(21) is transferred to the paper before the paper contacts the photosensitive drum(21) which may cause the picture quality to degrade.

In the present invention, symmetric AC power is applied to the photosensitive drum(21) and it is effective to discharge the on the paper by the symmetric AC power and the electric polarity of the front guide(33).

In general, because the electric resistance value of the paper fluctuates excessively in the range of between −10 through +10 ohms, when the DC power rather than the AC power is applied, the effect of discharging the charge is further increased.

Furthermore, power, of which polarity is the reverse to that of the toner, is applied to transcriber(27). In the present invention, because the voltage($V_T$) of the transcriber power supply portion(28) is established higher than the peak value($V_P$) of the photosensitive drum power supply portion(34), toner is transferred from the photosensitive drum (21) to the paper by the effect of the electric field in accordance with the power applied to the transcriber(27).

Henceforth, the paper, of which the charge is generated on the surface by the transcriber(27), is separated from the photosensitive drum(21) by the discharging brush(29). Because the discharge separating the paper from the photosensitive drum(21) is removed by the principle such as the aforesaid principle in the front guide(33), an improved discharging effect is obtained. Subsequently, the remaining toner which is not transcribed on the paper is removed from the photosensitive drum(21) and stored in a cleaning portion(32) as disused toner.

The same effect can be obtained when the AC and DC voltages are concurrently applied to the developer roller (25).

According to the method for supplying power of the present invention, the predetermined symmetric power is applied to a photosensitive drum to generate asymmetric AC potential on the surface thereof so that the picture image of good quality can be obtained and the influence of the surroundings can be prevented.

Furthermore, because only the symmetric AC power and DC power are used for high voltage circuit, configuration of said power circuit rather than asymmetric power circuit is more simplified so that the unit cost of the product is largely reduced.

While the present invention has been particularly shown and described with reference to the preferred embodiments thereof, it should be understood that various modifications, variations and other changes may be made to those skilled in the art without departing from the spirit of the invention.

The scope of the invention is therefore to be determined solely by the appended claims.

What is claimed is:

1. A method for supplying power to a copying machine comprising the steps of:

generating a uniform potential on a surface of a photosensitive drum through an electrifier;

changing the potential in a predetermined portion through an enveloper to form a latent image;

attracting toner from a developer having a developer roller on said photosensitive drum corresponding to the latent image;

transcribing by a transcriber the attracted toner on paper supplied through a guide;

discharging by a discharging brush a charge generated on the paper supporting a transcribed image, said guide and said discharging brush being grounded;

supplying a predetermined DC voltage to said developer roller, electrifier and transcriber; and supplying a symmetric AC voltage to said photosensitive drum concurrently with the supplying of said predetermined DC voltage to said developer roller, wherein said predetermined DC voltage supplying step and said symmetric AC voltage supplying step generate an asymmetric AC power on the surface of said photosensitive drum.

2. A method for supplying power to a copying machine according to claim 1, wherein said DC voltage and said symmetric AC power are concurrently supplied to said developer roller.

3. A method for supplying power to a copying machine according to claim 1, wherein the potential of the enveloped portion of the surface of the photosensitive drum has an absolute value represented by $|V_L|$, the potential of the unenveloped portion of the surface of said photosensitive drum has an absolute value represented by $|V_H|$, and the potential supplied to said developer roller has an absolute value represented by $|V_D|$, said $|V_D|$ being a value between said absolute value of the potential to attract said toner to the enveloped portion and the unenveloped portion of the surface of said photosensitive drum by a polarity of said toner such that $|V_L|<|V_D|<|V_H|$.

4. A method for supplying power to a copying machine according to claim 1, wherein the predetermined DC voltage supplied to said transcriber in the predetermined DC voltage supplying step has a polarity that is opposite to that of said toner and a magnitude larger than a predetermined DC level of the symmetric AC voltage supplied to said photosensitive drum to transfer and to attract said toner from said photosensitive drum to the paper.

5. A method for supplying power to a copying machine comprising the steps of:

generating a uniform potential on a surface of a photosensitive drum through an electrifier;

changing the potential in a predetermined portion through an enveloper to form a latent image;

attracting toner from a developer having a developer roller on said photosensitive drum corresponding to the latent image;

transcribing by a transcriber the attracted toner on paper supplied through a guide;

discharging by a discharging brush a charge generated on the paper supporting a transcribed image, said guide and said discharging brush being grounded;

supplying a predetermined DC voltage to said developer roller, electrifier and transcriber; and supplying a symmetric AC voltage to said photosensitive drum, wherein said predetermined DC voltage supplying step and said symmetric AC voltage supplying step generate an asymmetric AC power on the surface of said photosensitive drum, and wherein said DC voltage and said symmetric AC power are concurrently supplied to said developer roller.

6. A method for supplying power to a copying machine according to claim 5, wherein the potential of the enveloped portion of the surface of the photosensitive drum has an absolute value represented by $|VL|$, the potential of the unenveloped portion of the surface of said photosensitive drum has an absolute value represented by $|VH|$, and the potential supplied to said developer roller has an absolute value represented by $|VD|$, said $|VD|$ being a value between said absolute value of the potential to attract said toner to the enveloped portion and the unenveloped portion of the surface of said photosensitive drum by a polarity of said toner such that $|VL|<|VD|<|VH|$.

7. A method for supplying power to a copying machine according to claim 5, wherein the predetermined DC voltage supplied to said transcriber in the predetermined DC voltage supplying step has a polarity that is opposite to that of said toner and a magnitude larger than a predetermined DC level of the symmetric AC voltage supplied to said photosensitive drum to transfer and to attract said toner from said photosensitive drum to the paper.

8. A method for supplying power to a copying machine comprising the steps of:

generating a uniform potential on a surface of a photosensitive drum through an electrifier;

changing the potential in a predetermined portion through an enveloper to form a latent image;

attracting toner from a developer having a developer roller on said photosensitive drum corresponding to the latent image;

transcribing by a transcriber the attracted toner on paper supplied through a guide;

discharging by a discharging brush a charge generated on the paper supporting a transcribed image, said guide and said discharging brush being grounded;

supplying a predetermined DC voltage to said developer roller, electrifier and transcriber; and supplying a symmetric AC voltage to said photosensitive drum, said predetermined DC voltage supplying step and said symmetric AC voltage supplying step generate an asymmetric AC power on the surface of said photosensitive drum, wherein the potential of the enveloped portion of the surface of the photosensitive drum has an absolute value represented by $|VL|$, the potential of the unenveloped portion of the surface of said photosensitive drum has an absolute value represented by $|VH|$, and the potential supplied to said developer roller has an absolute value represented by $|VD|$, said $|VD|$ being a value between said absolute value of the potential to attract said toner to the enveloped portion and the unenveloped portion of the surface of said photosensitive drum by a polarity of said toner such that $|VL|<|VD|<|VH|$.

9. A method for supplying power to a copying machine according to claim 8, wherein said DC voltage and said symmetric AC power are concurrently supplied to said developer roller.

10. A method for supplying power to a copying machine according to claim 8, wherein the predetermined DC voltage supplied to said transcriber in the predetermined DC voltage supplying step has a polarity that is opposite to that of said toner and a magnitude larger than a predetermined DC level of the symmetric AC voltage supplied to said photosensitive drum to transfer and to attract said toner from said photosensitive drum to the paper.

11. A method for supplying power to a copying machine comprising the steps of:

generating a uniform potential on a surface of a photosensitive drum through an electrifier;

changing the potential in a predetermined portion through an enveloper to form a latent image;

attracting toner from a developer having a developer roller on said photosensitive drum corresponding to the latent image;

transcribing by a transcriber the attracted toner on paper supplied through a guide;

discharging by a discharging brush a charge generated on the paper supporting a transcribed image, said guide and said discharging brush being grounded;

supplying a predetermined DC voltage to said developer roller, electrifier and transcriber; and supplying a symmetric AC voltage to said photosensitive drum, wherein said predetermined DC voltage supplying step and said symmetric AC voltage supplying step generate an asymmetric AC power on the surface of said photosensitive drum, wherein the predetermined DC voltage supplied to said transcriber in the predetermined DC voltage supplying step has a polarity that is opposite to that of said toner and a magnitude larger than a predetermined DC level of the symmetric AC voltage supplied to said photosensitive drum to transfer and to attract said toner from said photosensitive drum to the paper.

12. A method for supplying power to a copying machine according to claim 11, wherein said DC voltage and said symmetric AC power are concurrently supplied to said developer roller.

13. A method for supplying power to a copying machine according to claim 11, wherein the potential of the enveloped portion of the surface of the photosensitive drum has an absolute value represented by $|VL|$, the potential of the unenveloped portion of the surface of said photosensitive drum has an absolute value represented by $|VH|$, and the potential supplied to said developer roller has an absolute value represented by $|VD|$, said $|VD|$ being a value between said absolute value of the potential to attract said toner to the enveloped portion and the unenveloped portion of the surface of said photosensitive drum by a polarity of said toner such that $|VL| < |VD| < |VH|$.

* * * * *